US006965740B2

(12) United States Patent
Nakahata

(10) Patent No.: US 6,965,740 B2
(45) Date of Patent: Nov. 15, 2005

(54) IMAGE FORMING APPARATUS AND SHEET DETECTING UNIT INCORPORATED IN THE IMAGE FORMING APPARATUS

(75) Inventor: Akinobu Nakahata, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/943,498

(22) Filed: Sep. 17, 2004

(65) Prior Publication Data

US 2005/0095019 A1 May 5, 2005

(30) Foreign Application Priority Data

Sep. 18, 2003 (JP) ..... P.2003-326309

(51) Int. Cl.[7] ..... G03G 15/00
(52) U.S. Cl. ..... 399/16; 399/124; 399/397
(58) Field of Search ..... 399/16, 124, 322, 399/343, 397; 271/265.01

(56) References Cited

U.S. PATENT DOCUMENTS 5,915,691 A * 6/1999 Deguchi et al. ..... 271/265.01
6,151,458 A * 11/2000 Sato et al. ..... 399/16

FOREIGN PATENT DOCUMENTS

JP 2000-072282 3/2000
JP 2000-072284 3/2000

* cited by examiner

*Primary Examiner*—Daniel J. Colilla
*Assistant Examiner*—Dave A. Ghatt
(74) *Attorney, Agent, or Firm*—Hogan & Hartson, LLP

(57) ABSTRACT

An image forming apparatus includes a transfer unit transferring a toner image on a first face of a sheet, a fixing unit fixing the toner image onto the first face of the sheet, and a sheet detecting unit detecting the sheet in a sheet transporting path. The sheet detecting unit includes a rotator which rotates by a slide contact on a second face which is backside of the first face of the sheet, and a supporting member which supports the rotator rotatably. The rotator is comprised of a material which is charged by the slide contact on the sheet with a first polarity, the first polarity being opposed to a second polarity with which a toner of the toner image is charged. The supporting member is comprised of a material charged by the slide contact on the sheet with the second polarity.

7 Claims, 3 Drawing Sheets

IMAGE FORMING APPARATUS AND SHEET DETECTING UNIT INCORPORATED IN THE IMAGE FORMING APPARATUS

BACKGROUND OF THE INVENTION

The present invention relates to an image forming apparatus, and particularly to an image forming apparatus which can detect a sheet on which an image is to be formed and can transport the sheet without staining it with toner and deteriorating image quality.

Heretofore, an image forming apparatus which forms an image with toner on transportation paper has been known. In this image forming apparatus, generally a laser beam is scanned on a photoconductor on the basis of image data thereby to form an electrostatic latent image on the photoconductor. The electrostatic latent image on the photoconductor is developed with toner and made visible to form a toner image, the toner image is transferred onto the transportation paper, and thereafter the transportation paper is pressed by a heat roller thereby to fix the toner image.

In this image forming apparatus, in order to transport paper in synchronization with image forming processing, a mechanism of detecting paper to be transported is arranged at each section of the apparatus. For example, a turn lever is arranged in a position where the transportation paper comes into slide-contact, and a turn of the turn lever by the transportation paper is detected by a sensor such as a switch.

As such the paper detecting mechanism, for example, a paper detecting mechanism of a image forming apparatus provided on the downstream side of a fixing section which fixes the toner image has been proposed. The paper detecting mechanism includes a rotator, which is provided at a leading end of the slide-contacting turn lever, for rotating by slide-contact with the transportation paper in order to reduce generation of static electricity in the transportation paper due to the slide-contact with the turn lever, or generation of damage and wear (for example refer to JP-A-2000-72282 and J P-A-2000-72284).

However, in such the related image forming apparatus, it is necessary to arrange the paper detecting mechanism also between a transfer section which transfers the toner image onto the transportation paper and the fixing section which fixes the toner image onto the transportation paper.

The toner image transferred onto the transportation paper, which is transported between the transfer section and the fixing section, is fixed yet. Therefore, there is fear that the toner is easily scattered and image quality deteriorates, and further when the floating toner in the air attaches and accumulates on the turn lever, the transportation paper which comes into slide-contact with the turn lever is stained with the toner. Specifically, in case that the turn lever is formed of a material which is charged negatively by the slide-contact with the transportation paper, and the toner is charged negatively, the toner on the transportation paper which has not been fixed yet repels to the turn lever so that a white streak (toner deletion) is occurred in the image. Further, in case that the turn lever is formed of nylon resin having strong positive charge acceptance, the floating toner in the surrounding atmosphere is attracted to the turn lever so that the floating toner is attached and accumulated onto the turn lever, whereby a leading end portion of the transportation paper, which firstly comes into slide-contact with the turn lever is stained with the toner.

Therefore, even if, the paper detecting mechanism, having the turn lever and the rotator provided on a leading end of the turn lever, is located between the transfer section and the fixing section, in spite of the presence or absence of the rotator, there is fear that the toner on the transportation paper scatters so that the image quality is deteriorated, or the toner is positively attached and accumulated on the turn lever so that the transportation paper is stained with the toner. It is difficult to simultaneously remove the image deterioration and the paper stain with high reliability.

SUMMARY OF THE INVENTION

It is therefore an object of the present invention to provide an image forming apparatus provided with a detection mechanism for detecting transportation paper located between a transfer section and a fixing section, the detection mechanism can detect the paper without affecting a toner image on a transportation paper in quality and without attracting the floating toner on the turn lever, so that the paper is not stained with the toner and the image is not deteriorated in quality.

In order to achieve the above object, according to the present invention, there is provided an image forming apparatus, comprising:

a transfer unit, which transfers a toner image on a first face of a sheet;

a fixing unit, which fixes the toner image onto the first face of the sheet;

a sheet detecting unit, which detects the sheet in a sheet transporting path between the transfer unit and the fixing unit, and slidingly contacts with the sheet, wherein the sheet detecting unit including:

a rotator, which rotates by a slide contact on a second face which is backside of the first face of the sheet; and a supporting member, which supports the rotator rotatably;

wherein the rotator is comprised of a material which is charged by the slide contact on the sheet with a first polarity, the first polarity being opposed to a second polarity with which a toner of the toner image is charged; and wherein the supporting member is comprised of a material charged by the slide contact on the sheet with the second polarity.

Here, considering a charge tendency of each material, it is preferable that the supporting member is comprised of an alloy material of acrylonitrile-butadiene-styrene (ABS) resin and polycarbonate (PC) resin. Further, the rotator may be is comprised of polyacetal (POM) resin. Further, the rotator may be formed in the shape of a disc or a cylinder, or may have plural projections on its peripheral surface, that is, design of the rotator may be appropriately changed.

The supporting member is located in the sheet transporting path. When a leading end of the sheet comes into contact with the supporting member, the supporting member guides the sheet toward the rotator while slidingly contacting on the sheet so that the supporting member is moved to allow the sheet to pass through in the sheet transporting path.

In the invention, the rotator that mainly comes into slide-contact with the transportation sheet rotates, whereby the sheet detecting unit side is hardly charged. In addition, in case that the toner is charged negatively, the rotator is charged positively due to the slide-contact with the sheet, and the supporting member of the rotator is charged negatively. On the other hand, in case that the toner is charged positively, the rotator is charged negatively due to the slide-contact with the sheet, and the supporting member of the rotator is charged positively. Therefore, the toner does not repel the rotator that comes into contact with the back surface of the toner image formed transportation sheet, but the toner repels the supporting member that guides the slide-contacting transportation sheet to the rotator, whereby the toner is not attached and accumulated. Accordingly, it is prevented that the image quality of the toner image that has not been fixed yet is deteriorated by detection of the transportation sheet, and simultaneously it is prevented that even in case that a leading end of the transportation sheet, comes into slide-contact with the supporting member of the rotator, the transportation sheet is not stained with the toner. At this time, even in case that a small amount of the floating toner attaches onto the rotator, since this rotator rotates in slide-contact with the back surface of the transportation sheet from the leading end of the sheet to the rear end, and rotates, it is prevented that the toner is collected onto only the leading end of the transportation sheet and the leading end is stained with the toner.

Further, though the supporting member may be fixed, it is so constituted that: the supporting member is located in the sheet transporting path; when the paper leading end transported in the transporting path comes into contact with the supporting member, the supporting member brings the sheet leading end into slide-contact therewith thereby to guide the sheet leading end toward the rotator; and the supporting member moves so that the sheet can pass in the transporting path. Hereby, the sheet transported in the transporting path can be detected without receiving large impact.

According to the present invention, there is also provided a sheet detecting unit incorporated in an image forming apparatus for detecting a sheet, comprising:

a rotator, which rotates by a slide contact on a first face of the sheet, the first face being backside of a second face on which an toner image is transferred;

a supporting member, which supports the rotator rotatably;

wherein the rotator is comprised of a material which is charged by the slide contact on the sheet with a first polarity, the first polarity being opposed to a second polarity with which a toner of the toner image is charged; and wherein the supporting member is comprised of a material charged by the slide contact on the sheet with the second polarity.

According to the invention, since the rotator that rotates in slide-contact with the transportation sheet is formed of the charge material having an opposite tendency to the toner tendency, it is prevented that the toner on the transportation sheet repels the rotator and the image quality of the toner image is affected. Further, since the supporting member of this rotator is formed of the charge material having the same tendency as the toner tendency, it is prevented that the floating toner is attracted to the supporting member and the slide-contacting transportation sheet is stained. Therefore, by the simple constitution including the rotator and its supporting member, the sheet transported between transfer section and the fixing section can be detected without being stained and deteriorating the image quality.

BRIEF DESCRIPTION OF THE DRAWINGS

The above objects and advantages of the present invention will become more apparent by describing in detail preferred exemplary embodiments thereof with reference to the accompanying drawings, wherein:

FIGS. 2A and 2B are diagrams showing a detecting unit of the image forming apparatus, wherein FIG. 2A is a front view of the detecting unit and FIG. 2B is a side view of the detecting unit; and FIGS. 3A and 3B a diagrams showing a detecting unit of an image forming apparatus according to a second embodiment of the invention, wherein FIG. 3A is a partially enlarged front view of the detecting unit and FIG. 3B is a partially enlarged side view of the detecting unit.

DETAILED DESCRIPTION OF THE PREFERRED EMBODIMENTS

Figure 1:
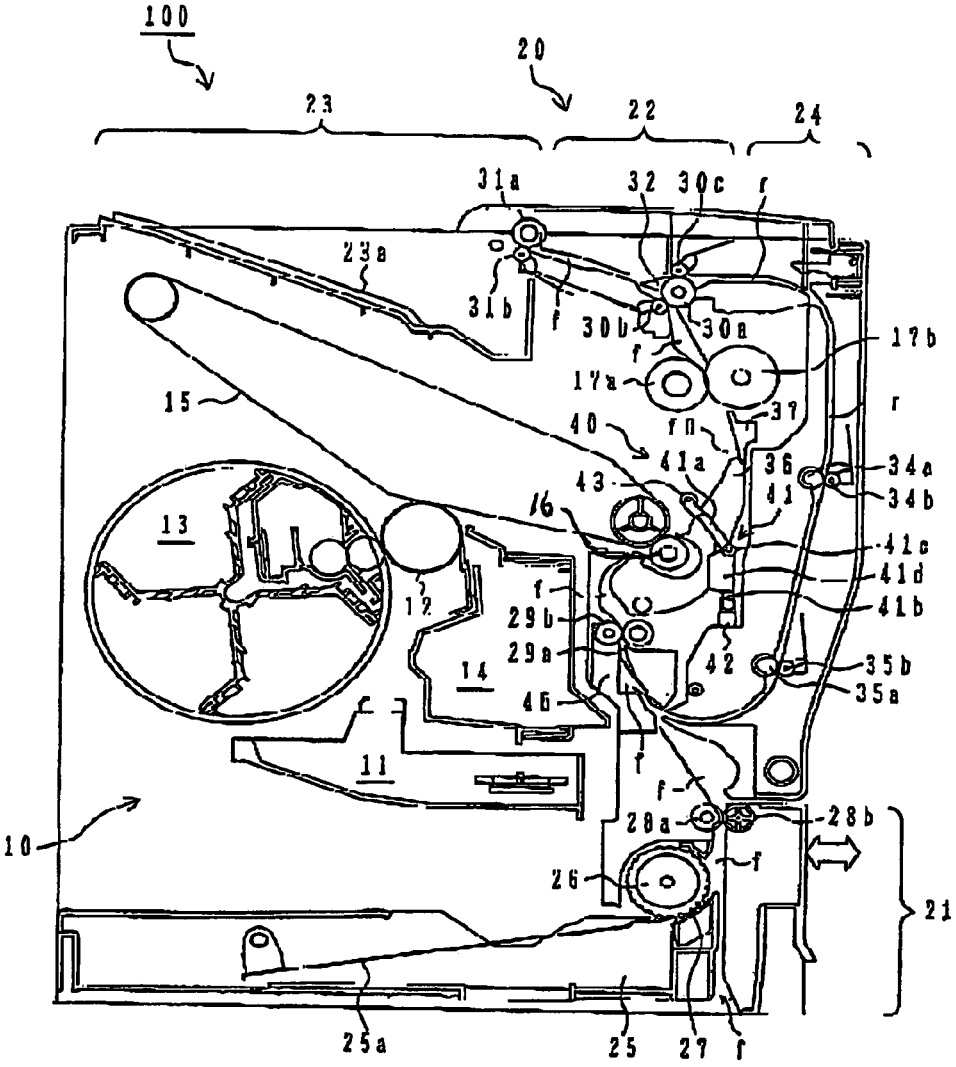
FIG. 1 is a perspective side view showing an image forming apparatus according to a first embodiment of the invention.
Figure 2A:
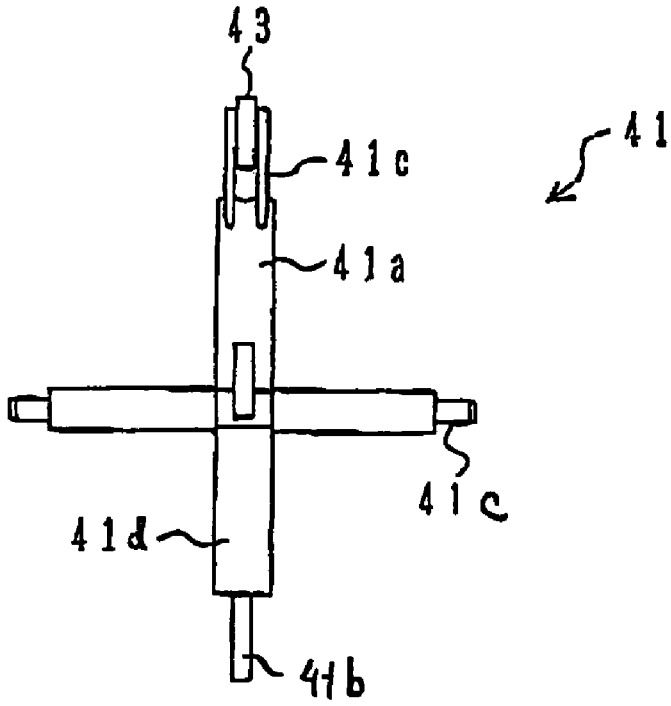
Figure 2B:
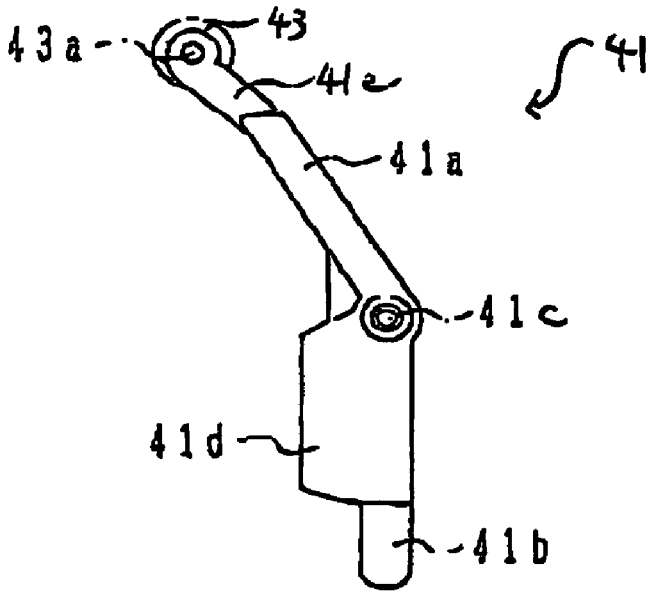

A preferred embodiment of the invention will be described below with reference to drawings. FIGS. 1, 2A and 2B are diagrams showing an image forming apparatus according to the first embodiment of the invention.

In FIG. 1, an image forming apparatus 100 is connected to an external apparatus such as a personal computer which creates and outputs an image such as a character to be used. This image forming apparatus 100 includes an image recording device 10 which records and forms a received image data such as a character on one side or both sides of recording paper (transportation paper) by an electrophotographic method, and a paper transporting device 20 which transports plural stocked recording paper (cut paper) to this image recording device 10. The paper transporting device 20 transports the recording paper on which the image has been recorded and formed to the outside of the device, and stocks the recording papers.

The image recording device 10 includes a laser beam scanning unit 11 which scans a laser beam on the basis of image data; a photoconductor drum 12 which is irradiated with the scanned laser from this laser scanning device 11 thereby to form an electrostatic latent image on the basis of the image data on its surface; a development rotary unit 13 which houses developing units for respective colors which develop the electrostatic latent image on this photoconductor drum 12 with toners of yellow (Y), cyan (C), magenta (M), and black (K); a waste toner tank 14 which recovers the residual toner on the photoconductor drum 12 and stores it; a transfer belt 15 which receives a toner image formed on the photoconductor drum 12 and forms a toner image which is transferable and recordable on the recording paper (monochromatic image or color image); a transfer roller 16 which transfers its toner image on the recording paper transported so as to be nipped between this transfer belt 15 and the roller 16; and a pair of fixing rollers 17*a*, 17*b* which heat and press the recording paper which has come to be transported with the image transferred thereon thereby to fix the toner image, and which transport its recording paper further downstream with the recording paper between. Namely, the transfer belt 15 and the transfer roller 16 constitute a transfer section, and the fixing roller pair 17*a*, 17*b* constitutes a fixing section.

The paper transporting device 20 includes a supply section 21 which sets plural sheets of recording paper on which the image is to be recorded and formed, and supplies them to a transportation path f one by one; a transporting section 22 which transports the supplied recording paper to the image recording device 10 through the transportation path f; a paper discharge section 23 which discharges the recording paper on which the image is formed by the image recording device 10 to the outside of the device; and a reversal section 24 which turns over the recording paper of which one surface has the recorded image and re-transports the recording paper through a re-transportation path r and the transporting path f on the upstream side of the image recording device 10 again.

The supply section 21 includes a paper cassette 25 which has a lifting plate 25*a* on which the plural sheets of recording paper are placed and set, and which is detachably attached to the lower portion of the apparatus body; a pick up roller 26 which comes into pressure contact with a recording paper sheaf raised by the lifting plate 25*a* and rotates thereby to pull out the recording paper; and a separation pad 27 which presses this pick up roller 26 at the constant pressure, and comes into slide-contact with the pulled-out recording paper thereby to limit the transportation of the recording paper to the downstream side.

In this supply section 21, the topmost recording paper pulled out from the inside of the paper cassette 25 is brought into pressure-contact with the pick up roller 26, while the recording paper located below the topmost recording paper is brought into contact into slide-contact with the recording paper located in the still lower position or the separation pad 27. Hereby, by use of difference among coefficients of friction of these pick up roller 26, separation pad 27, and the recording paper, only the topmost recording paper with which the pick up roller 26 comes into pressure contact can be pulled out with the rotation of the roller 26, and its one recording paper can be separated from the recording paper sheaf and supplied through the transportation path f of the transporting section 22 to the downstream side. In this supply section 21, the transportation path f is formed also on a front side of the paper cassette 25, and a multistage cassette 25 can be set, so that the recording paper can be transported downstream through its transportation path f by a pair of relay rollers 28*a*, 28*b* of the described-later transporting section 22, which are arranged for each paper cassette 25.

The transporting section 22 includes, in addition to the transfer belt 15, the transfer roller 16, and the fixing roller pair 17*a*, 17*b* of the image recording device 10, the relay roller pair 28*a*, 28*b*, a pair of registration rollers 29*a*, 29*b* and a pair of relay rollers 30*a*, 30*b*. The relay roller pair 28*a*, 28*b* receives the recording paper in the transportation path f supplied by the pick up roller 26 of the supply section 21 and transports the recording paper further downstream. The pair of registration rollers 29*a*, 29*b* receive the recording paper transported in the transportation path f by the relay roller pair 28*a*, 28*b*, and transports the recording paper to an image recording and forming section constituted by the transfer belt 15 and transfer roller 16 while sandwiching the recording paper by the relay roller pair 28*a*, 28*b*. The pair of relay rollers 30*a*, 30*b* receive the recording paper having the formed image in the transportation path f and fed out from the fixing roller pair 17*a*, 18*b* of the image recording device 10, and transports it further downstream with it between.

This transporting section 22 transports, the recording paper fed from the supply section 21 and passing in the transportation path f, to the image recording and forming position by the transfer belt 15 and transfer roller 16 with it between so that the registration roller pair 29*a*, 29*b* can synchronize with drive of the image recording device 10. Thereafter, the transporting section 22 transports the recording paper through the fixing position by the fixing roller pair 17*a*, 17*b*. At this time, the registration roller pair 29*a*, 29*b* receives the recording paper (recording paper in the paper cassette 25 that has not been used yet, or recording paper on one surface of which the image has been recorded and formed by the image recording device 10) which the relay roller pair 28*a*, 28*b*, or a relay roller pair 35*a*, 35*b* described later transports with it between, and transports it to the image recording and forming position by the image recording device 10.

The paper discharge section 23 has a pair of discharge rollers 31*a* and 31*b* which receive the recording paper that the relay roller pair 30*a*, 30*b* of the transporting section 22 transports the recording paper to the transportation path f, and which feed out and stock the recording paper onto a paper discharge table 23*a*. This paper discharge section 23 receives, from the transporting section 22, the recording paper on which the image has been recorded and formed, and discharges the recording paper to the outside of the device.

The discharge roller pair 31*a*, 31*b* of this paper discharge section 23 performs rotation-drive (paper discharge function) of discharging the recording paper onto the paper discharge table 23*a*, and further can be rotation-driven in the opposite direction in accordance with a recording mode of an image to be processed. In case that a two-side mode in which images are recorded and formed on two sides of the recording paper is specified, the rollers 31*a*, 31*b* stop temporarily the recording paper in a position where they nips a rear end of the recording paper that has been feed out on the paper discharge table 23*a* between them, and thereafter they are driven in the opposite direction, whereby they feed out the recording paper on one side of which the image has been recorded and formed to the re-transportation path r. Namely, this discharge roller pair 31*a*, 31*b* is also used as a reversal section 24.

The reversal section 24 comprises, in addition of the discharge roller pair 31*a*, 31*b* of the paper discharge section 23, a switching guide 32 which is arranged between this discharge roller pair 31*a*, 31*b* and the relay roller pair 30*a*, 30*b* of the transporting section 22, and switches the path in which the recording paper can pass to either the transportation path f or re-transportation path r; relay roller pairs 30*a*, 30*c*, and 34*a*, 34*b* which receive the recording paper that the discharge roller pair 31*a*, 31*b* lets pass in the re-transportation path r, and transport it further downstream with it between; and a pair of relay rollers 35*a*, 35*b* which receive the recording paper that this relay roller pair 34*a*, 34*b* transports in the re-transportation path r, and feed out it in the transportation path f on the upstream side of the registration roller pair 29*a*, 29*b* of the transporting section 22. Further, the switching guide 32 is so designed as to open the re-transportation path r as the transportation path of the recording paper by its own weight, and the recording paper transported by the relay roller pair 30*a*, 30*b* through the fixing roller pair 17*a*, 17*b* is passed to the discharge roller pair 31*a*, 31*b* of the discharge section 23 so as to push up the switching guide 32. Further, regarding the relay roller pair 30*a*, 30*b*, and the relay roller pair 30*a*, 30*c*, the relay roller 30*a* on the drive side is used in common, and the relay rollers 30*b* and 30*c* on the driven side are brought into pressure contact with the relay roller 30*a*, the relay roller pair 30*a*, 30*b* transports the recording paper in the transportation path f with it between, and the relay roller pair 30*a*, 30*c* transports the recording paper in the re-transportation path r with it between.

In this reversal section 24, the recording paper transported in the transportation path f by the relay roller pair 30*a*, 30*b* pushes up the switching guide 32 thereby to be passed to the discharge roller pair 31*a*, 31*b* of the paper discharge section 23 and come out from the lower surface of the switching guide 32. Thereafter, in case that the two-side mode is specified, the discharge roller pair 31*a*, 31*b* of the paper discharge section 23 is driven in the opposite direction. At this time, since the switching guide 32 is opening the re-transportation path r as the transportation path of the recording paper by its own weight, the discharge roller pair 31*a*, 31*b* lets the recording paper having the image formed on its one side pass in the re-transportation path r, and lets the relay roller pairs 30*a*, 30*c*, 34*a*, 34*b*, 35*a*, and 35*b* transport its recording paper, whereby the turned-over recording paper is transported again in the transportation path f, and passed to the registration roller pair 29*a*, 29*b* of the transporting section 22. Hereby, the recording paper, with the other surface (surface on which the image has not been formed) as a surface on which an image is to be recorded and formed, is again transported and supplied in the image recording and forming position by the image recording apparatus.

This paper transporting device 20 must transport the recording paper so as to detect the recording paper transported in the transportation path f, r, and synchronize with the processing operation of each section of the device, and paper detecting mechanisms that detect the recording paper in these transportation paths f, r are arranged in appropriate positions.

The paper detecting unit may select a method of detecting the presence and absence of the paper from either an optical type or a mechanical type according to its setting position. For example, an one-side open transporting path fo, wherein a guide surface for guiding the transfer surface side of the recording paper is omitted and only guides 36 and 37 for guiding the back surface side of the recording paper are formed, is formed between the fixing section constituted by the transfer belt 15 and the transfer roller 16 and the fixing section constituted by the fixing roller pair 17*a*, 17*b*. Therefore, the paper detecting mechanism can guide the recording paper without deteriorating image quality by contact with a toner image before fixing, which has been recorded and formed on one side (transfer surface side) of the recording paper. A mechanical type paper detecting mechanism 40, which detects the recording paper by bringing a turn lever into slide-contact with the back surface of the toner image transfer surface of the recording paper and turning the turn lever, is arranged in the transportation path fo.

Specifically, the paper detecting mechanism 40 includes a turn lever 41 and a sensor 42. The turn lever 41 includes a leading end part 41*a*, a rear end part 41*b* and a turn support 41*c*. The turn lever 41 is rotatably supported with the turn support 41*c* which is between the leading end part 41*a* and the rear end part 41*b*, and provided on the back surface side of the guide 36 defining one side of the transportation path fo. The sensor 42 detects the rear end part 41*b* when the turn lever 41 is in no-load state. This sensor 42 may detect the rear end part 41*b* of the turn lever 41 by any of a mechanical switch and an optical switch.

The turn lever 41 has a weight part 41*d* which is arranged between the turn support 41*c* and the rear end part 41*b*. When the turn lever 41 is in no load, the rear end part 41*b* is supported in a state where the rear end part 41*b* is arranged perpendicularly by weight of the weight part 41*d*. As a result, the rear end part 41*b* is detected by the sensor 42. In this state, the leading end part 41*a* is located in the transportation path fo so as to strike the recording paper to the leading end part 41*a*.

To be brief, in the turn lever 41, in case that the recording paper is transported in the transportation path fo between the transfer belt 15 and the transfer roller 16, and the fixing roller pair 17*a*, 17*b*, the leading end part 41*a* is struck by the leading end of the recording paper, thereby turns clockwise in FIG. 1 so that the paper can pass in the transportation path. Further, till the recording paper comes out from the transportation path fo, the back surface side of the toner image formed side of the recording paper is brought into slide-contact with a leading end of the leading end part 41*a*, and the turn lever 41 keeps the turning state in which the paper can pass. After the recording paper come out from the transportation path fo, the turn lever 41 turns counterclockwise in FIG. 1 by the weight of the weight part 41*d*, and the rear end part 41*b* returns to the perpendicularly hanging state.

When the recording paper passes through the transportation passage fo, the sensor 42 detects that the rear end part 41*b* is away from the detecting position in accordance with the turn of the turn lever 41 by the recording paper. On the other hand, before and after the recording paper passes through the transportation path fo, the sensor detects that the rear end part 41*b* returns and is located in the detecting position since the turn lever 41 is in no load.

Therefore, although the leading end part 41*a* of the turn lever 41 is located so as to interrupt the transportation path fo, since the turn lever 41 turns easily, the paper detecting mechanism 40 can reduce the shock onto the recording paper of which the leading end strikes on the leading end part 41*a*, can surely detect the presence and absence of the recording paper in the transportation path fo, and can relax accuracy of an assembly position. Further, the weight of the weight part 41*d* may be set to such a degree that the turn lever 41 can turn by small power. For example, in case that the rear end part 41*b* side can be made longer, it is not particularly necessary to provide the weight part 41*d*.

Further, as shown in FIG. 2, the turn lever (supporting member) 41 has support plates 41*e* formed by extending both side surfaces of the leading end part 41*a* in the leading end direction. A disk-shaped rotator 43 is rotatably supported by the support rod 43*a* which is provided between the support plates. The peripheral surface of this rotator 43 is exposed from the support plates 41*e* so that the rotator can come into slide-contact with the back surface of the recording paper. Namely, when the recording paper passes through the transportation path fo, the rotator 43 is driven and rotated while the leading end part 41*a* of the turn lever 41 comes into slide-contact with the back surface of the recording paper from the leading end of the recording paper to the rear end thereof after the leading end part 41*a* of the turn lever 41 is turned for guiding the recording paper. Further, the rotator 43 may be formed in a wide cylindrical shape.

Here, in the turn lever 41, in case that the toner is charged negatively, the leading end part or the like 41*a* to 41*e* is made of a material which tends to be similarly charged negatively by slide-contact with the recording paper. For example, the material is an alloy material of acrylonitrile-butadiene-styrene (ABS) resin and polycarbonate (PC) resin. Further, the rotator 43 is made of polyacetal (POM) resin, which tends to be charged positively by slide-contact of with the recording paper.

Therefore, the leading end or the like 41*a* to 41*e* of the turn lever 41 is negatively charged similarly to the toner when the leading end or the like 41*a* to 41*e* is charged by the slide-contact with the recording paper. Therefore, it hardly attract, attach and accumulate the toner floating near the transportation path fo on the leading end or the like 41*a* to 41*e*. In result, when the leading end of the recording paper passing the transportation path fo is guided by the leading end part 41*a*, the toner does not attach to the recording paper and does not stain the recording paper. Further, since the rotator 43 is driven and rotated in accordance with the movement of the recording paper when the rotator 43 comes into slide-contact with the recording paper, the charge amount can be discharged. Further, even in case that a small amount of toner attaches to the rotator 43 by the positive charge of the rotator 43 due to the slide-contact with the recording paper, when the rotator 43 rotates in slide-contact with the back surface side of the recording paper, a peripheral surface of the rotator 43 can be evenly brought into contact with the back surface of the recording paper, so that the toner is not attached onto only a part of the recording paper intensively and it does not stain the part. Further, since the rotator 43 tends to be positively charged oppositely to the toner, when the rotator 43 comes into slide-contact with the back surface of the recording paper, the rotator 43 does not repel the toner on the surface (transfer surface) of the recording paper, and does not cause a white streak in the toner image, so that quality of the toner image is not deteriorated.

In this embodiment, the turn lever 41 detecting the recording paper transported in the transportation path fo is set so that the leading end part or the like 41*a* to 41*e* of the turn lever 41 can be charged negatively by the slide-contact with the recording paper when the toner is charged negatively, and the rotator 43 can be charged positively. Therefore, the turn lever 41 can detect the recording paper transported in the transportation path fo without having such an influence that the image quality of the toner image formed on the recording paper is deteriorated.

Figure 3A:
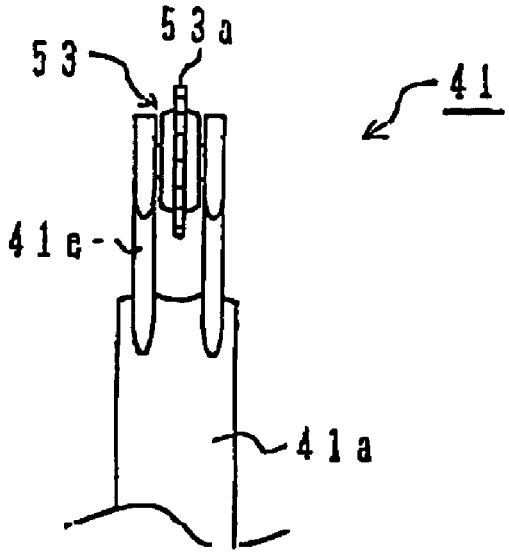
Figure 3B:
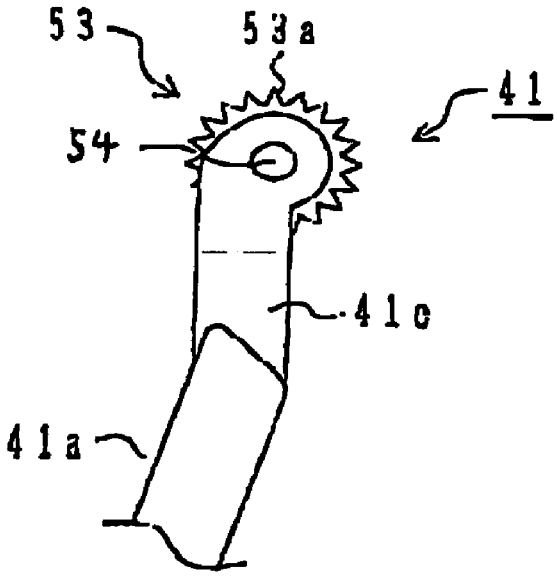

Further, in the second embodiment of the invention, as shown in FIGS. 3A and 3B, at the leading end part 41*a* of the turn lever 41, in place of the disc-shaped rotator 43, a star wheel shaped rotator 53 having plural projections on its peripheral surface may be supported rotatably by a support rod 54. In this case, only the leading end of the projection 53*a* can come into contact with the back surface of the recording paper. Therefore, the rotators 43, 53 may be selectively attached to the leading end part 41*a* of the turn lever 41 according to the condition such as the recording paper material.

Further, the turn lever 41 may select its material according to the negative or positive charging direction of the toner. In case that the toner is charged positively oppositely to that in the embodiments, the rotator 43, 53 may be formed of the material which tends to be charged negatively by the slide-contact of with the recording paper, while the leading end part or the like 41*a* to 41*e* may be formed of a material which tends to be charged positively.

Here, in the embodiments, the alloy material of ABS resin and PC resin, which is negatively charged weakly by the slide-contact (rub) with the recording paper, is used as the material of the leading end part or the like 41*a* to 41*e* of the turn lever 41; and the POM resin, which is charged positively, is used as the material of the rotator 43, 53. However, since the rotator 43, 53 is attached to this turn lever 41, the strength of charge is not important. For example, even in case that the leading end part or the like 41*a* to 41*e* of the turn lever 41 is formed of nylon resin which causes, in the turn lever having no rotator, the toner attachment and accumulation by the strong positive charge due to the slide-contact with the recording paper, the toner attachment and accumulation is a small matter due to the action and effects of the rotator 43, 53. Namely, the material of the leading end part or the like 41*a* to 41*e* of the turn lever 41, and the material of the rotator 43, 53 may be selected according to their directions charged by the slide-contact with the recording paper in accordance with the toner charged direction. However, as the materials of the leading end part or the like 41*a* to 41*e* of the turn lever 41, and of the rotators 43, 53, it is not necessary to specially select a material causing very strong charge, but it is more preferable to select a material having weak charge acceptance.

In the embodiment, though the case in which the invention is applied to an image forming apparatus which can form a color image has been described, the invention is not limited to this. For example, the invention may be applied to an image forming apparatus which forms a monochromatic image.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

What is claimed is:

1. An image forming apparatus, comprising:

a transfer unit, which transfers a toner image on a first face of a sheet;

a fixing unit, which fixes the toner image onto the first face of the sheet;

a sheet detecting unit, which detects the sheet in a sheet transporting path between the transfer unit and the fixing unit, and slidingly contacts with the sheet, wherein the sheet detecting unit including:

a rotator, which rotates by a slide contact on a second face which is backside of the first face of the sheet; and a supporting member, which supports the rotator rotatably;

wherein the rotator is comprised of a material which is charged by the slide contact on the sheet with a first polarity, the first polarity being opposed to a second polarity with which a toner of the toner image is charged; and wherein the supporting member is comprised of a material charged by the slide contact on the sheet with the second polarity.

2. The image forming apparatus as set forth in claim 1, wherein the supporting member is comprised of an alloy material of acrylonitrile-butadiene-styrene (ABS) resin and polycarbonate (PC) resin.

3. The image forming apparatus as set forth in claim 1, wherein the rotator is comprised of polyacetal (POM) resin.

4. The image forming apparatus as set forth in claim 1, wherein the rotator has either a disc shape or a cylindrical shape.

5. The image forming apparatus as set forth in claim 1, wherein the rotator has a plurality of projections on a peripheral surface thereof.

6. The image forming apparatus as set forth in claim 1, wherein the supporting member is located in the sheet transporting path; and wherein when a leading end of the sheet comes into contact with the supporting member, the supporting member guides the sheet toward the rotator while slidingly contacting on the sheet so that the supporting member is moved to allow the sheet to pass through in the sheet transporting path.

7. A sheet detecting unit incorporated in an image forming apparatus for detecting a sheet, comprising:

a rotator, which rotates by a slide contact on a first face of the sheet, the first face being backside of a second face on which an toner image is transferred;

a supporting member, which supports the rotator rotatably;

wherein the rotator is comprised of a material which is charged by the slide contact on the sheet with a first polarity, the first polarity being opposed to a second polarity with which a toner of the toner image is charged; and wherein the supporting member is comprised of a material charged by the slide contact on the sheet with the second polarity.

* * * * *